US009231312B2

(12) United States Patent
Omori et al.

(10) Patent No.: US 9,231,312 B2
(45) Date of Patent: Jan. 5, 2016

(54) TERMINAL-WIRE ASSEMBLY

(71) Applicants: AUTONETWORKS TECHNOLOGIES, LTD., Yokkaichi, Mie (JP); SUMITOMO WIRING SYSTEMS, LTD., Yokkaichi, Mie (JP); SUMITOMO ELECTRIC INDUSTRIES, LTD., Osaka-shi, Osaka (JP)

(72) Inventors: Yasuo Omori, Yokkaichi (JP); Hiroki Hirai, Yokkaichi (JP); Masaaki Tabata, Yokkaichi (JP)

(73) Assignees: AUTONETWORKS TECHNOLOGIES, LTD. (JP); SUMITOMO WIRING SYSTEMS, LTD. (JP); SUMITOMO ELECTRIC INDUSTRIES, LTD. (JP)

( * ) Notice: Subject to any disclaimer, the term of this patent is extended or adjusted under 35 U.S.C. 154(b) by 0 days.

(21) Appl. No.: 14/372,099

(22) PCT Filed: Jan. 8, 2013

(86) PCT No.: PCT/JP2013/000018

§ 371 (c)(1),
(2) Date: Jul. 14, 2014

(87) PCT Pub. No.: WO2013/105484

PCT Pub. Date: Jul. 18, 2013

(65) Prior Publication Data

US 2014/0342621 A1 Nov. 20, 2014

(30) Foreign Application Priority Data

Jan. 12, 2012 (JP) ..... 2012-003972

(51) Int. Cl.

| | |
|---|---|
| ***H01R 4/18*** | (2006.01) |
| ***H01R 11/09*** | (2006.01) |
| *H01R 4/62* | (2006.01) |
| *H01R 13/28* | (2006.01) |

(52) U.S. Cl.
CPC ..... *H01R 4/184* (2013.01); *H01R 11/09* (2013.01); *H01R 4/185* (2013.01); *H01R 4/62* (2013.01); *H01R 13/28* (2013.01)

(58) Field of Classification Search
USPC ..... 439/878, 851, 865, 881, 849, 855, 867
See application file for complete search history.

(56) References Cited

FOREIGN PATENT DOCUMENTS

| | | |
|---|---|---|
| JP | 55-131070 | 9/1980 |
| JP | 08-250165 | 9/1996 |
| JP | 2003178824 | 6/2003 |
| JP | 2004253167 | 9/2004 |

*Primary Examiner* — Alexander Gilman
(74) *Attorney, Agent, or Firm* — Gerald E. Hespos; Michael J. Porco; Matthew T. Hespos

(57) ABSTRACT

A wiring harness (1) includes a copper wire (3), an aluminum wire (4) and a ground terminal (2) connected to these wires. The ground terminal (2) includes two wire-side terminal portions (11), (12). A conductor barrel (11*b*) of the first wire-side terminal portion (11) is crimped to have such a first crimping height (H1) that the conductor barrel (11*b*) can come into contact with a surface of a conductor (3*a*) of the copper wire (3). A conductor barrel (12*b*) of the second wire-side terminal portion (12) is crimped to a conductor (4*a*) of the aluminum wire (4) to have such a second crimping height (H2) lower than the first crimping height (H1) that the conductor barrel (12*b*) can come into contact with the conductor (4*a*) of the aluminum wire (4) through an oxide film (4*d*) covering a surface of the conductor (4*a*).

3 Claims, 13 Drawing Sheets

TERMINAL-WIRE ASSEMBLY

BACKGROUND

1. Field of the Invention

The present invention relates to a terminal-wire assembly with a plurality of wires mixedly including a copper wire and an aluminum wire.

2. Description of the Related Art

Conventionally, a ground connection terminal is connected to an end of a ground wire as described in Japanese Unexamined Patent Publication No. H10-208815 to connect the ground wire included in an automotive wiring harness to a ground section of a vehicle. The ground connection terminal includes a wire-side terminal portion and a ground-side terminal portion. The wire-side terminal portion is shaped to be connectable to the end of the ground wire. Specifically, the wire-side terminal portion includes one crimping portion such as a conductor barrel to be crimped to a conductor exposed to outside at the end of one ground wire. The ground-side terminal portion is connectable to the ground section on a wall surface of a vehicle body.

Copper wires whose conductors are made of copper are frequently used as wires such as ground wires. In recent years, wires made of metals different from copper such as aluminum wires including a conductor made of aluminum have been used.

Here, the ground connection terminal as described above includes one crimping portion connectable to one ground wire, but it is difficult to collectively connect a plurality of wires mixedly including a copper wire and an aluminum wire to a ground section with high reliability. Specifically, a surface of a conductor of an aluminum wire is normally covered with an oxide film. Thus, the crimping portion needs to come into contact with the conductor made of aluminum by breaking the oxide film. Thus, a crimping degree higher than that for copper conductors is required. Further, since copper and aluminum differ in hardness, crimped states tend to vary. Thus, in the case of crimping the crimping portion to the aluminum wire at the same crimping degree as that in the case of crimping the crimping portion to the copper wire, it is difficult to maintain connection reliability.

Further, in the case of collectively fastening both the copper wire and the aluminum wire by one crimping portion, electrolytic corrosion may occur between different types of metals.

In the case of individually crimping a plurality of ground terminals to a copper wire and an aluminum wire, the number of the ground terminals increases. Thus, it is difficult to collectively connect a plurality of ground terminals to a ground section in a limited space.

The present invention aims to provide a terminal-wire assembly in which a plurality of wires mixedly including a copper wire and an aluminum wire are collectively connected to a predetermined section with high reliability.

SUMMARY OF THE INVENTION

The present invention is directed to a terminal-wire assembly, including a copper wire including a conductor made of copper; an aluminum wire including a conductor made of aluminum or aluminum alloy; and a crimping terminal connectable to ends of the respective copper wire and aluminum wire; wherein the crimping terminal includes a first wire-side terminal portion shaped to be connectable to the end of the copper wire, a second wire-side terminal portion shaped to be connectable to the end of the aluminum wire and an electrical connecting portion bonded to the first and second wire-side terminal portions and shaped to be electrically connectable to at least one mating section; the first wire-side terminal portion includes a first crimping portion shaped to be crimpable to the conductor exposed at the end of the copper wire; the second wire-side terminal portion includes a second crimping portion shaped to be crimpable to the conductor exposed at the end of the aluminum wire; the first crimping portion is crimped to the conductor of the copper wire to have such a first crimping height that the first crimping portion is capable of coming into contact with a surface of the conductor of the copper wire; and the second crimping portion is crimped to the conductor of the aluminum wire to have such a second crimping height that the second crimping portion is capable of coming into contact with the conductor of the aluminum wire through an oxide film covering a surface of the conductor.

DETAILED DESCRIPTION OF THE PREFERRED EMBODIMENTS

A wiring harness 1 as a preferred embodiment of a terminal-wire assembly of the present invention is described with reference to the drawings.

Figure 1:
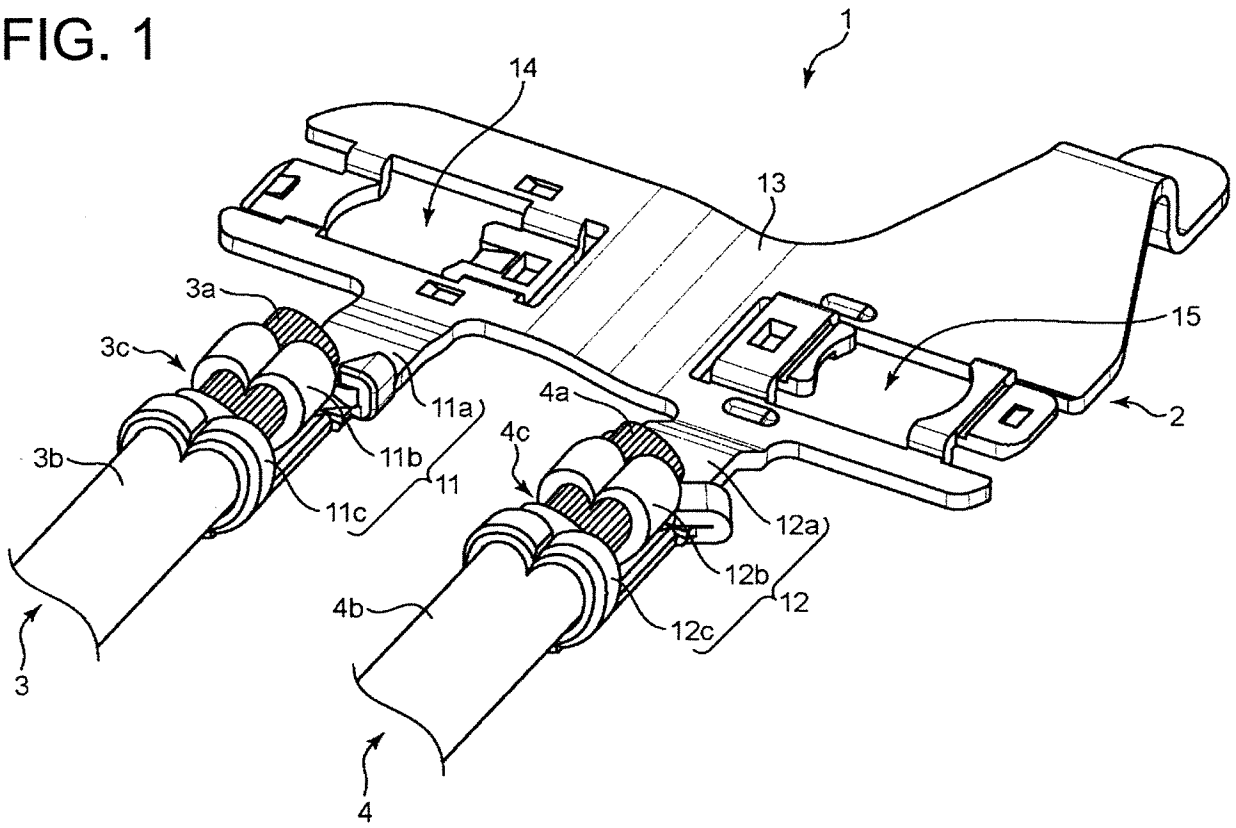
FIG. 1 is a perspective view showing a wiring harness according to an embodiment of a terminal-wire assembly of the present invention.
Figure 2:
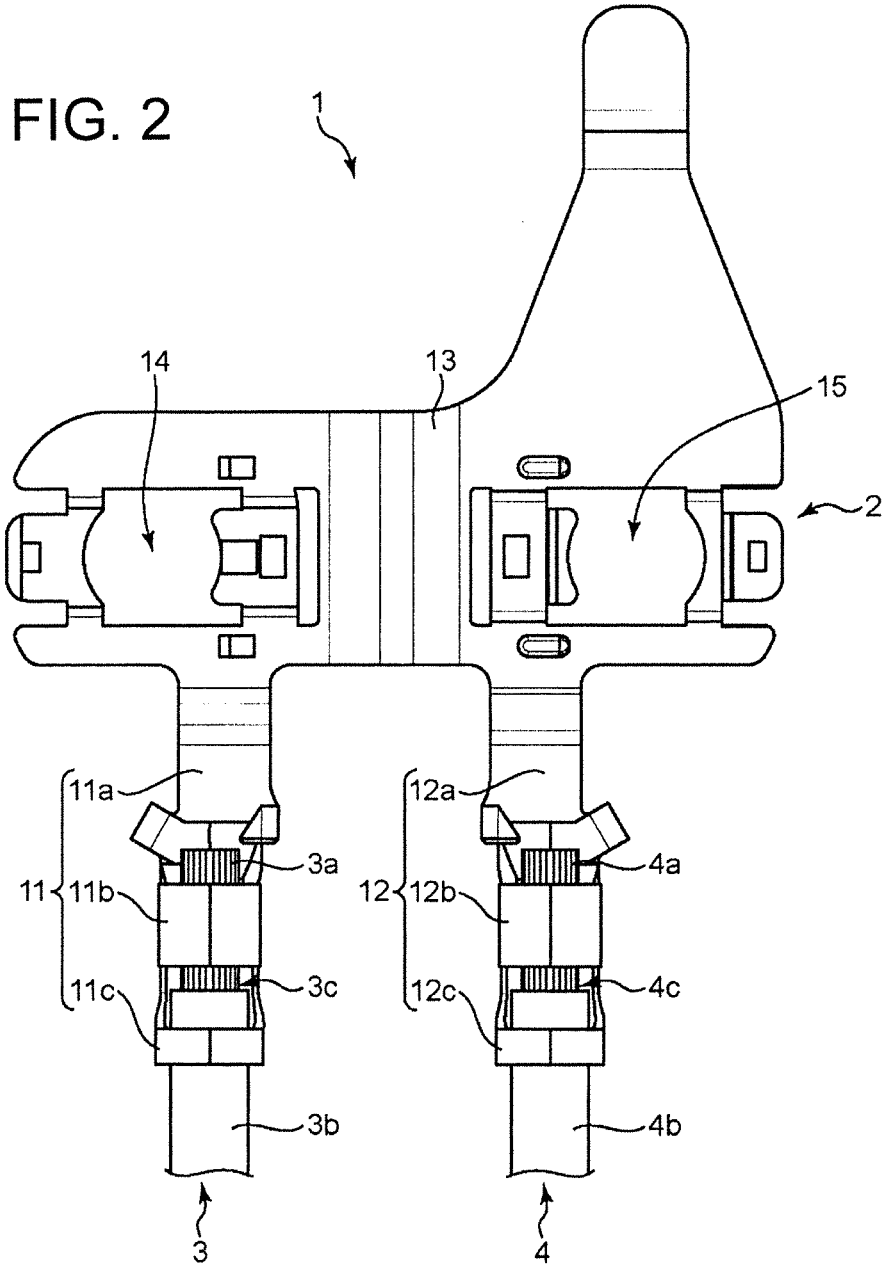
FIG. 2 is a plan view of the wiring harness of FIG. 1.
Figure 3:
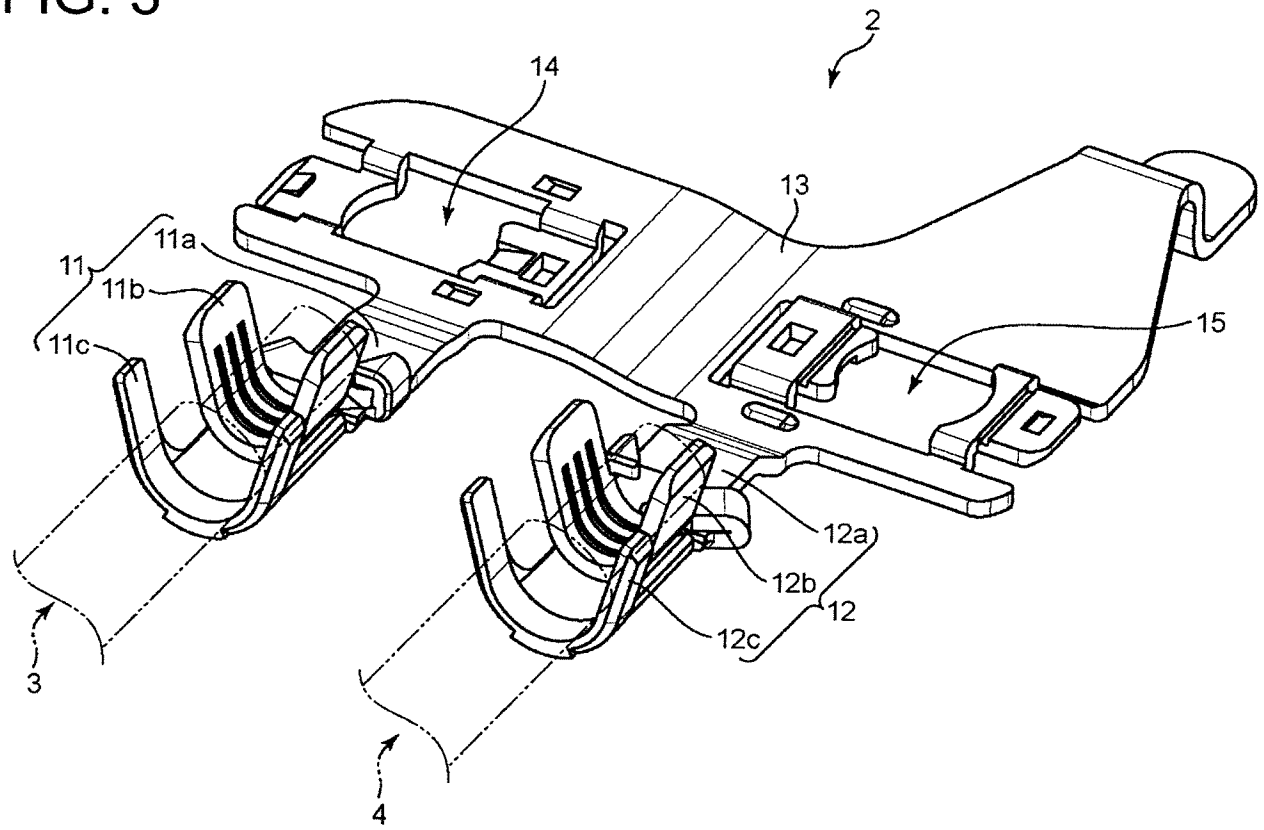
FIG. 3 is a perspective view of a ground terminal of FIG. 1.

The wiring harness 1 shown in FIGS. 1 and 2 is a terminal-wire assembly for ground connection and composed of a ground terminal 2, a copper wire 3 and an aluminum wire 4.

The copper wire 3 and the aluminum wire 4 are two wires respectively drawn out from specific circuits to be grounded and have the same basic shape, but conductors of these are made of different materials.

Specifically, the copper wire 3 includes a copper conductor 3*a* and an insulation coating 3*b* covering the copper conductor 3*a*. The insulation coating 3*b* is removed at an end part 3*c* of the copper wire 3 to expose the copper conductor 3*a* to outside.

The copper conductor 3*a* is exposed to outside in a state where a surface thereof is not covered with an oxide film or the like.

The aluminum wire 4 includes an aluminum conductor 4*a* and an insulation coating 4*b* covering the aluminum conductor 4*a*. The insulation coating 4*b* is removed at an end part 4*c* of the aluminum wire 4 to expose the aluminum conductor 4*a* to outside.

Figure 10:
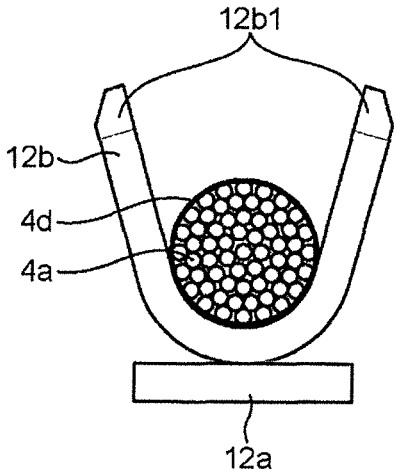
FIG. 10 is an enlarged view showing a state where an aluminum wire is arranged in a second conductor barrel of FIG. 4.
Figure 11:
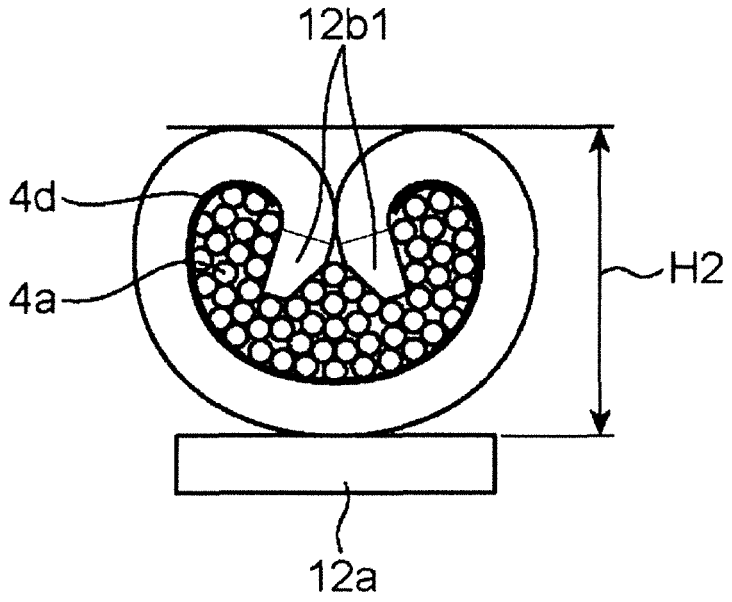
FIG. 11 is an enlarged view showing a state where the second conductor barrel of FIG. 4 is crimped to the aluminum wire.

Since the aluminum conductor 4*a* is more easily oxidized on exposure to air than the copper conductor 3*a*, a surface thereof exposed to outside at the end part 4*c* is normally covered with a thin oxide film 4*d* (see FIGS. 10 to 11).

In this embodiment, an outer diameter of the copper conductor 3*a* is set equal to that of the aluminum conductor 4*a*. However, the present invention is not limited to this.

As shown in FIGS. 3 to 7, the ground terminal 2 is shaped to be simultaneously connectable to ends of both the copper wire 3 and the aluminum wire 4 and connect these two wires 3, 4 respectively to a first bolt G1 and a second bolt G2 as two ground sections. The first and second bolts G1, G2 are, for example, hexagon head bolts to be threadably engaged with screw holes formed in a wall surface of a vehicle body. Alternatively, the first and second bolts G1, G2 may be embedded bolts projecting from the wall surface of the vehicle body and unillustrated nuts are threadably engaged with these embedded bolts.

Specifically, the ground terminal 2 integrally includes a first wire-side terminal portion 11, a second wire-side terminal portion 12 and a ground-side terminal portion 13, and the entire ground terminal 2 is manufactured of a conductive material. The ground terminal 2 corresponds to a crimping terminal of the present invention.

The ground-side terminal portion 13 includes a first bolt connection hole 14 and a second bolt connection hole 15 respectively connectable to the first and second bolts G1, G2. The first and second wire-side terminal portions 11, 12 are arranged side by side in a direction parallel to an arrangement direction X (see FIG. 4) of the first and second bolt connection holes 14, 15. The ground-side terminal portion 13 corresponds to an electrical connecting portion of the present invention. Further, the first and second bolt connection holes 14, 15 respectively correspond to a first ground section connecting part and a second ground section connecting part of the present invention.

The first wire-side terminal portion 11 is shaped to be connectable to an end of the copper wire 3. Specifically, the first wire-side terminal portion 11 includes a base portion 11*a*, a conductor barrel 11*b* and an insulation barrel 11*c*. The conductor barrel 11*b* corresponds to a first crimping portion of the present invention.

The base portion 11*a* is in the form of a long and narrow plate. One end part of the base portion 11*a* is joined to the outer peripheral surface of the ground-side terminal portion 13. The base portion 11*a* extends in a direction perpendicular to the arrangement direction X of the above two bolt connection holes 14, 15.

The conductor barrel 11*b* is shaped to be crimpable to the copper conductor 3*a* exposed at the end of the copper wire 3 and, specifically, composed of a strip-like part in which tip parts 11*b*1 (see FIGS. 8 and 9) on opposite sides are open. The conductor barrel 11*b* is arranged to extend perpendicularly to an extending direction of the base portion 11*a*. An intermediate part of the conductor barrel 11*b* is joined to the upper surface of the base portion 11*a*. The conductor barrel 11*b* can be crimped to the exposed part of the copper conductor 3*a* of the end part 3*c* of the copper wire 3 by embracing the exposed part inside (see FIGS. 8 and 9). When the copper conductor 3*a* is fastened by crimping, the opposite tip parts 11*b*1 of the conductor barrel 11*b* are wound inwardly and embedded into the copper conductor 3*a* while being guided by unillustrated dies.

Similarly to the conductor barrel 11*b*, the insulation barrel 11*c* is in the form of a strip in which tip parts on opposite ends are open, and is arranged side by side in parallel with the conductor barrel 11*b* to extend perpendicularly to the extending direction of the base portion 11*a*. The insulation barrel 11*c* can fix a part of the end part 3*c* of the copper wire 3 where the copper conductor 3*a* is not exposed, i.e. a part covered with the insulation coating 3*b* by embracing the covered part (see FIGS. 1 to 2).

The second wire-side terminal portion 12 is shaped to be connectable to an end of the aluminum wire 4. Specifically, the second wire-side terminal portion 12 includes a base portion 12*a*, a conductor barrel 12*b* and an insulation barrel 12*c*. The conductor barrel 12*b* corresponds to a second crimping portion of the present invention.

The base portion 12*a* is in the form of a long and narrow plate. One end part of the base portion 12*a* is joined to the outer peripheral surface of the ground-side terminal portion 13. The base portion 12*a* extends in a direction perpendicular to the arrangement direction X of the above two bolt connection holes 14, 15.

The conductor barrel 12*b* is shaped to be crimpable to the aluminum conductor 4*a* exposed at the end of the aluminum wire 4 and, specifically, composed of a strip-like part in which tip parts 12*b*1 (see FIGS. 10 and 11) on opposite sides are open. The conductor barrel 12*b* is arranged to extend perpendicularly to an extending direction of the base portion 12*a*. An intermediate part of the conductor barrel 12*b* is joined to the upper surface of the base portion 12*a*. The conductor barrel 12*b* can be crimped to the exposed part of the aluminum conductor 4*a* of the end part 4*c* of the aluminum wire 4 by embracing the exposed part inside (see FIGS. 10 and 11). When the aluminum conductor 4*a* is fastened by crimping, the opposite tip parts 12*b*1 of the conductor barrel 12*b* are wound inwardly and embedded into the aluminum conductor 4*a* while being guided by the unillustrated dies.

Similarly to the conductor barrel 12*b*, the insulation barrel 12*c* is in the form of a strip in which tip parts on opposite ends are open, and is arranged side by side in parallel with the conductor barrel 12*b* to extend perpendicularly to the extending direction of the base portion 12*a*. The insulation barrel 12*c* can fix a part of the end part 4*c* of the aluminum wire 4 where the aluminum conductor 4*a* is not exposed, i.e. a part covered with the insulation coating 4*b* by embracing the covered part (see FIGS. 1 to 2).

The ground-side terminal portion 13 is in the form of a flat plate including a step portion 13*a* and has a size connectable to the first and second bolts G1, G2. The ground-side terminal portion 13 is formed with the first and second bolt connection holes 14, 15 at positions corresponding to the first and second bolts G1, G2. The first bolt connection hole 14 is a connecting part connectable to the first bolt G1. The second bolt connection hole 15 is a connecting part connectable to the second bolt G2. The first and second bolt connection holes 14, 15 are in such a relative positional relationship as to be simultaneously connectable to the first and second bolts G1, G2. This enables the copper wire 3 connected to the first wire-side terminal portion 11 and the aluminum wire 4 connected to the second wire-side terminal portion 12 to be respectively connected to the first and second bolts G1, G2 as the ground sections.

Figure 8:
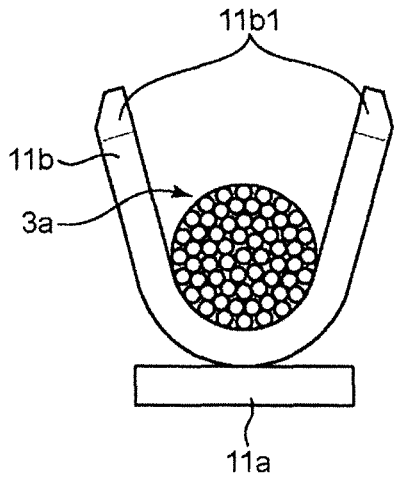
FIG. 8 is an enlarged view showing a state where a copper wire is arranged in a first conductor barrel of FIG. 4.
Figure 9:
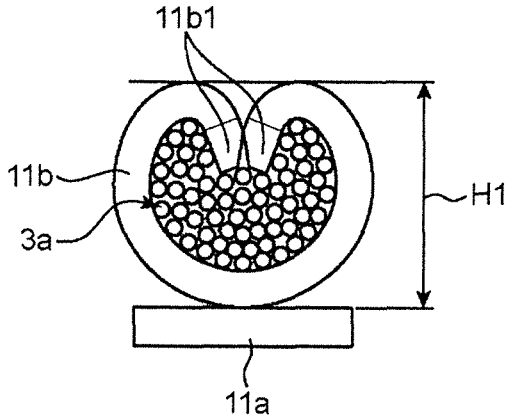
FIG. 9 is an enlarged view showing a state where the first conductor barrel of FIG. 4 is crimped to the copper wire.

In the wiring harness 1 configured as described above, the conductor barrel 11*b* of the first wire-side terminal portion 11 is crimped to the copper conductor 3*a* of the copper wire 3 to have such a first crimping height H1 that the conductor barrel 11*b* can come into contact with the surface of the copper conductor 3*a* of the copper wire 3 as shown in FIGS. 8 and 9.

Here, the crimping height H1 is the entire height of the conductor barrel 11*b* in a state where the tip parts 11*b*1 on the opposite sides of the conductor barrel 11*b* are wound inwardly and embedded into the copper conductor 3*a* as shown in FIG. 9.

On the other hand, as shown in FIGS. 10 and 11, the tip parts 12*b*1 on the opposite sides of the conductor barrel 12*b* in the second wire-side terminal portion 12 are crimped to the aluminum conductor 4*a* to have such a second crimping height H2 that the tip parts 12*b*1 can come into contact with the conductor 4*a* of the aluminum wire 4 through the oxide film 4*d* covering the surface of the aluminum conductor 4*a*. This enables the tip parts 12*b*1 on the opposite sides of the conductor barrel 12*b* to reliably reach and come into contact with the aluminum conductor 4*a* through the oxide film 4*d* covering the surface of the conductor 4*a*.

Here, the crimping height H2 is the entire height of the conductor barrel 12*b* in a state where the tip parts 12*b*1 on the opposite sides of the conductor barrel 12*b* are wound inwardly and embedded into the aluminum conductor 4*a* as shown in FIG. 11.

Although the second crimping height H2 is set lower than the first crimping height H1 in this embodiment, the present invention is not limited to this. The second crimping height H2 has only to be set such that the tip parts 12*b*1 can come into contact with the aluminum conductor 4*a* through the oxide film 4*d* covering the surface of the conductor 4*a*.

(Ground Connection Device 100)

Figure 12:
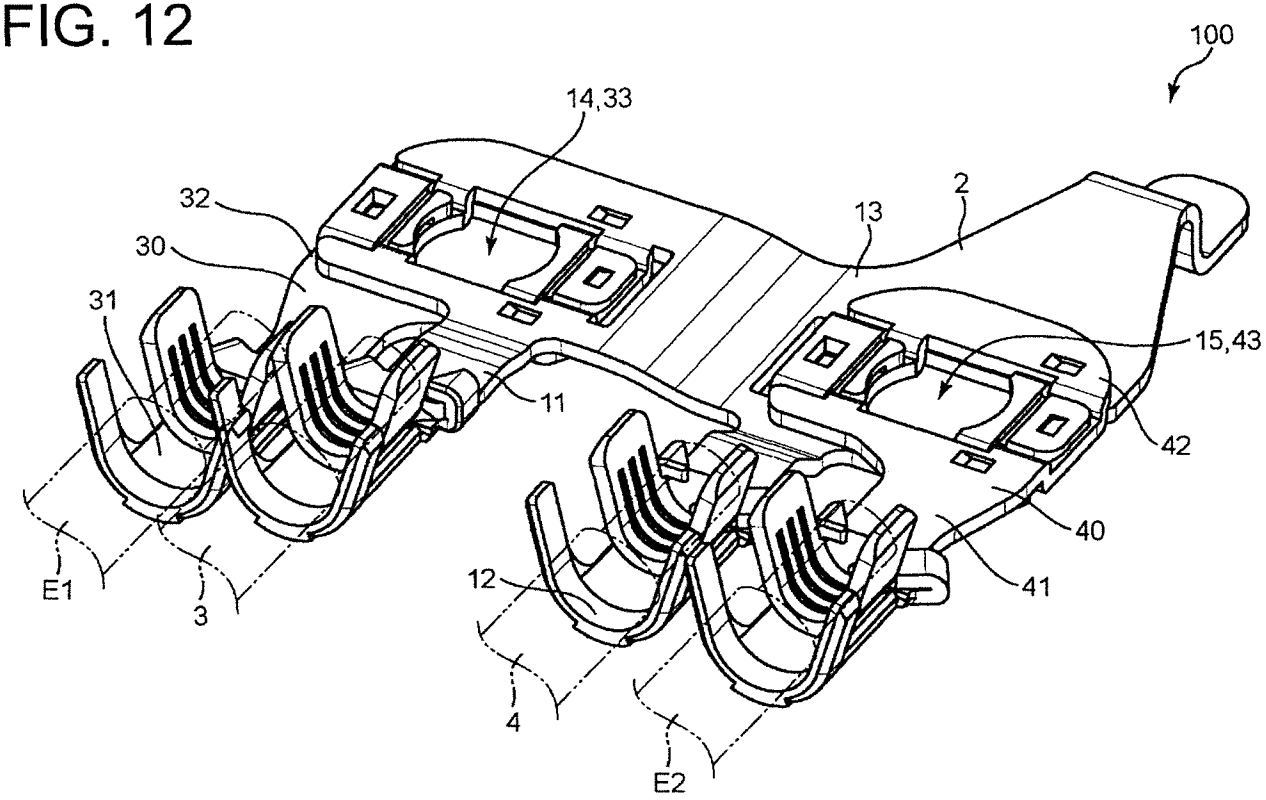
FIG. 12 is a perspective view of a ground connection device structured such that two additional ground terminals are connected to the ground terminal of FIG. 1.
Figure 13:
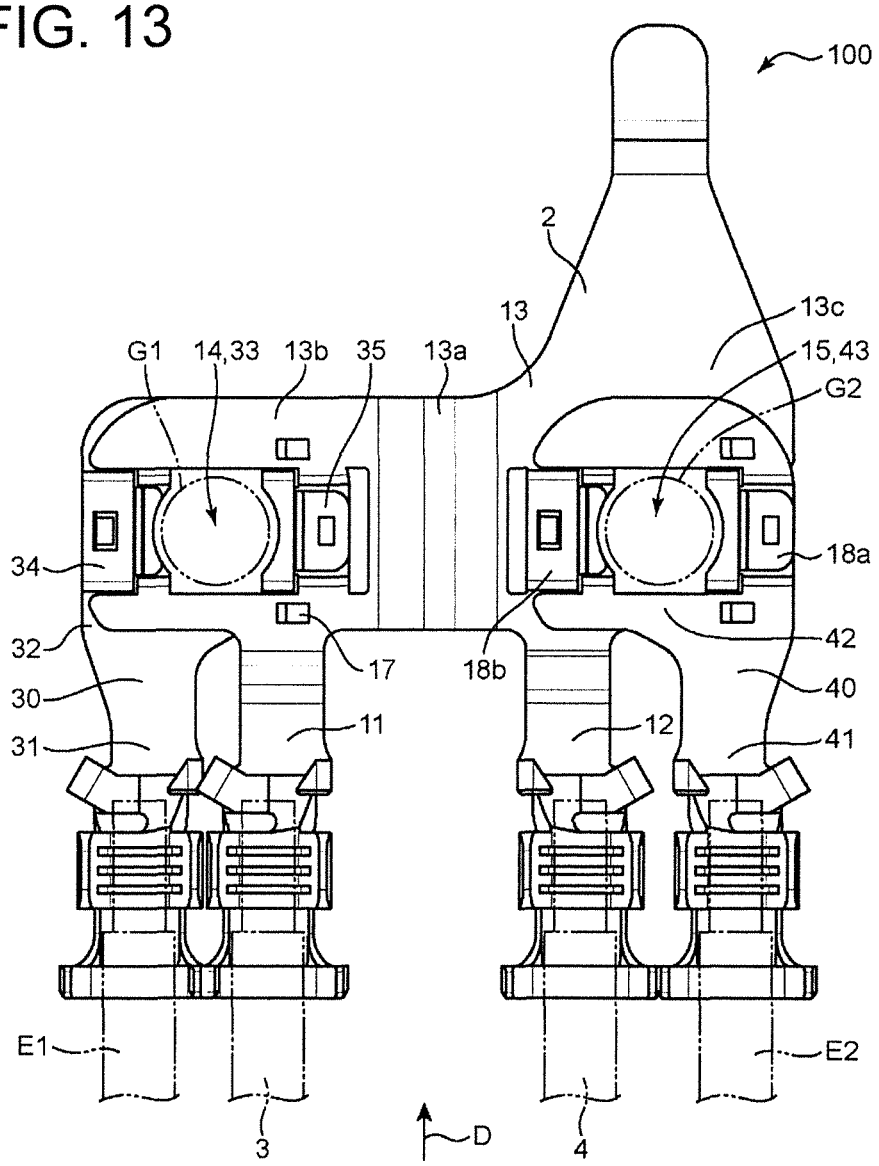
FIG. 13 is a plan view of the ground connection device of FIG. 12.
Figure 14:
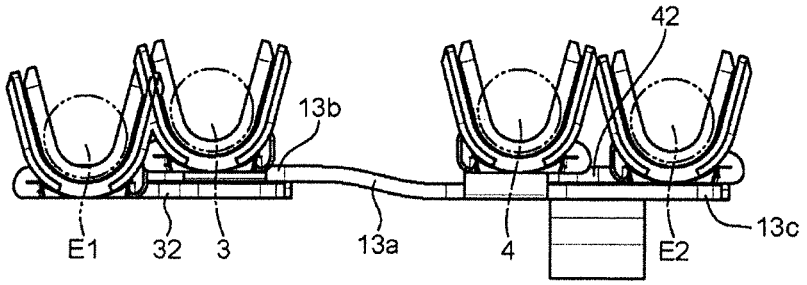
FIG. 14 is a view of the ground connection device of FIG. 13 when viewed in a direction of an arrow D.

As shown in FIGS. 12 to 14, a ground connection device 100 capable of collectively connecting a maximum of four ground wires to the first and second bolts G1, G2 as the two ground sections can be configured by coupling other ground terminals (additional ground terminals 30, 40) to the ground terminal 2.

Specifically, the ground connection device 100 shown in FIGS. 12 to 14 includes the above ground terminal 2, the first additional ground terminal 30 and the second additional ground terminal 40 and is so structured that the first and second additional ground terminals 30, 40 are arranged to overlap on opposite upper and lower sides of the ground terminal 2.

The first additional ground terminal 30 connects a first additional ground wire E1 to the first bolt G1 and also to the second bolt G2 via the ground terminal 2.

The second additional ground terminal 40 connects a second additional ground wire E2 to the second bolt G2 and also to the first bolt G1 via the ground terminal 2.

As shown in FIGS. 4, 5, 13 and 14, the step portion 13*a* of the ground-side terminal portion 13 is formed between the first and second bolt connection holes 14, 15. A first part 13*b* of the ground-side terminal portion 13 where the first bolt connection hole 14 is formed is higher than a second part 13*c* where the second bolt connection hole 15 is formed, and the first and second parts 13*b*, 13*c* are coupled by the step portion 13*a*.

By the ground-side terminal portion 13 including the step portion 13*a*, a ground-side terminal portion 32 of the first additional ground terminal 30 can be arranged below the first part 13*b* and a ground-side terminal portion 42 of the second additional ground terminal 40 can be arranged above the second part 13*c* as shown in FIGS. 12 to 14. A height difference between the first and second parts 13*b*, 13*c* is set at about the thickness of the ground-side terminal portion 32.

Further, in the first part 13*b*, the ground-side terminal portion 13 includes a first coupling portion 16 to be coupled to the first additional ground terminal 30 and first crimping portions 17 for crimping the ground terminal 30 to the first coupling portion 16.

The first coupling portion 16 is coupled to the ground-side terminal portion 32 of the first additional ground terminal 30 in a state where the first bolt connection hole 14 of the ground-side terminal portion 13 and a first bolt connection hole 33 (see FIG. 15) of the ground-side terminal portion 32 are caused to communicate so as to be simultaneously connectable to the first bolt G1.

Figure 4:
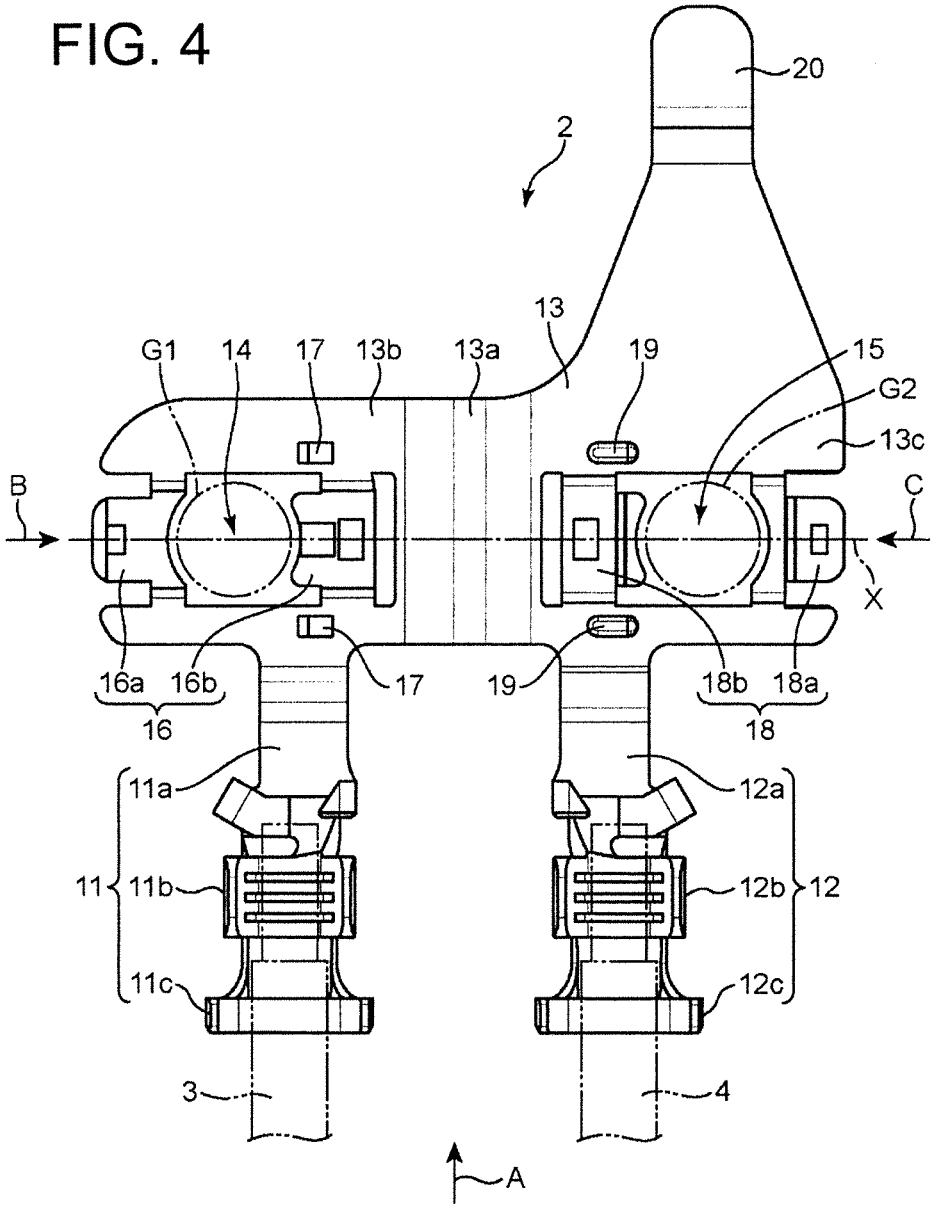
FIG. 4 is a plan view of the ground terminal of FIG. 1.

The first coupling portion 16 includes contact pieces 16*a* and 16*b* as shown in FIG. 4. The contact pieces 16*a*, 16*b* are arranged side by side in parallel with the above direction X and project in a direction away from the step portion 13*a*.

Figure 5:
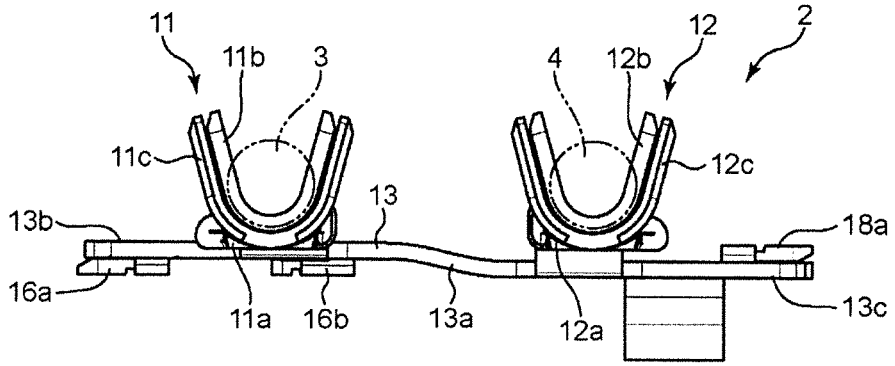
FIG. 5 is a view of the ground terminal of FIG. 4 when viewed in a direction of an arrow A.
Figure 6:
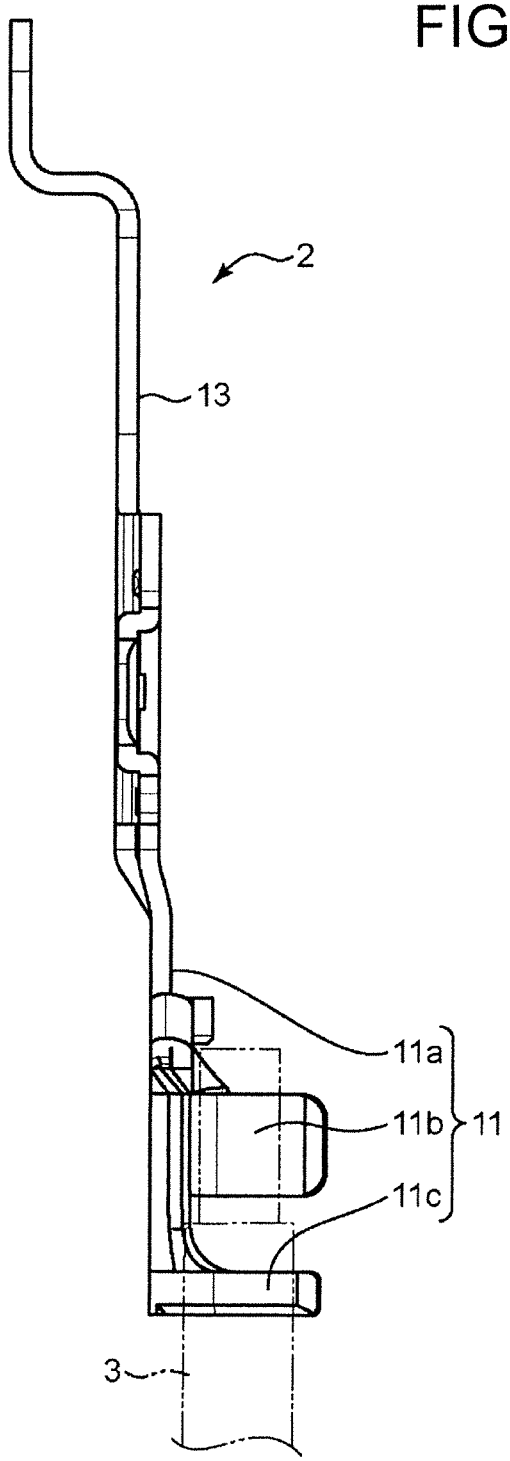
FIG. 6 is a view of the ground terminal of FIG. 4 when viewed in a direction of an arrow B.
Figure 7:
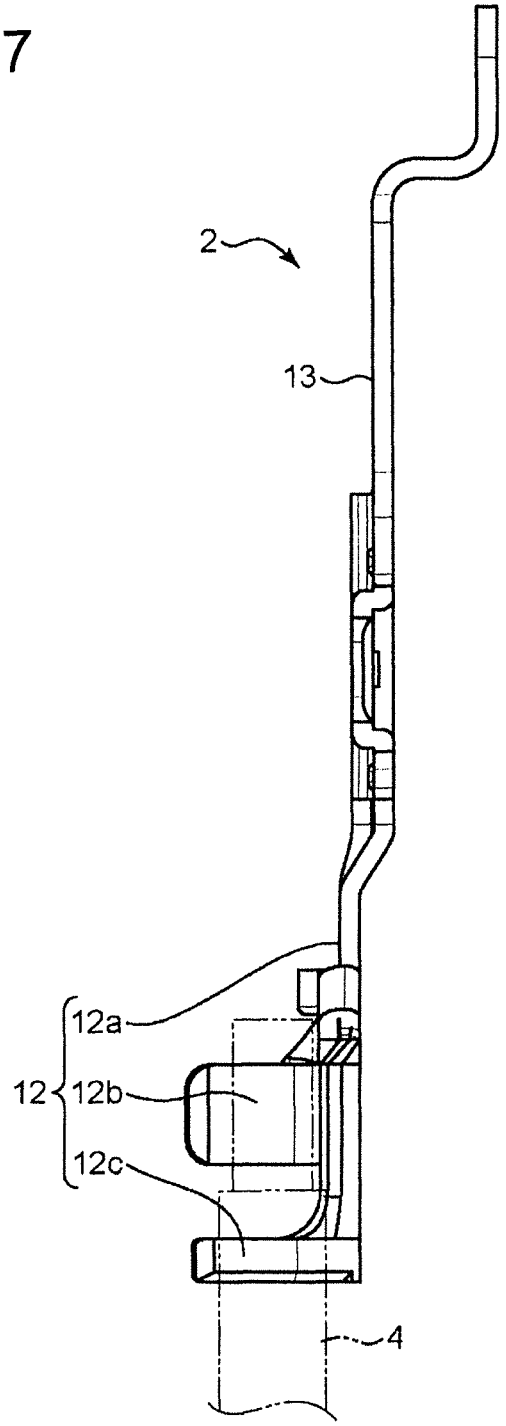
FIG. 7 is a view of the ground terminal of FIG. 4 when viewed in a direction of an arrow C.

The contact pieces 16*a*, 16*b* are arranged at positions lower than the lower surface of the first part 13*b* of the ground-side terminal portion 13 (see FIG. 5). The contact pieces 16*a*, 16*b* are engageable with contact pieces 34, 35 (see FIG. 15) of the ground-side terminal portion 32 in the first additional ground terminal 30.

The first crimping portions 17 are parts projecting downward from the lower surface of the first part 13*b* of the ground-side terminal portion 13. The first crimping portions 17 are arranged at opposite sides (specifically, opposite sides in a direction perpendicular to the arrangement direction X of the two connection holes 14, 15) of the contact piece 16*b*. The first crimping portions 17 can crimp the contact pieces 34, 35 of the ground-side terminal portion 32 in the first additional ground terminal 30 to be described later to the contact pieces 16*a*, 16*b* of the first coupling portion 16 by pressing the ground-side terminal portion 32 toward the contact pieces 16*a*, 16*b* of the first coupling portion 16.

Further, in the second part 13*c*, the ground-side terminal portion 13 includes a second coupling portion 18 to be coupled to the second additional ground terminal 40 and second crimping portions 19 for crimping the ground terminal 40 to the second coupling portion 18.

The second coupling portion 18 is coupled to the ground-side terminal portion 42 of the second additional ground terminal 40 in a state where the second bolt connection hole 15 of the ground-side terminal portion 13 and a second bolt connection hole 43 (see FIG. 16) of the ground-side terminal portion 42 are caused to communicate so as to be simultaneously connectable to the second bolt G2.

The second coupling portion 18 includes contact pieces 18*a* and 18*b* as shown in FIG. 4. The contact pieces 18*a*, 18*b* are arranged side by side in parallel with the above direction X and project in a direction away from the step portion 13*a*.

The contact pieces 18*a*, 18*b* are arranged at positions higher than the upper surface of the second part 13*c* of the ground-side terminal portion 13. The contact pieces 18*a*, 18*b* are engageable with contact pieces 44, 45 (see FIG. 16) of the ground-side terminal portion 42 in the second additional ground terminal 40.

The second crimping portions 19 are parts projecting upward from the upper surface of the second part 13*c* of the ground-side terminal portion 13. The second crimping portions 19 are arranged at opposite sides (specifically, opposite sides in the direction perpendicular to the arrangement direction X of the two connection holes 14, 15) of the contact piece

18*b*. The second crimping portions 19 can crimp the contact pieces 44, 45 of the ground-side terminal portion 42 in the second additional ground terminal 40 to be described later to the contact pieces 18*a*, 18*b* of the second coupling portion 18 by pressing the ground-side terminal portion 42 toward the contact pieces 18*a*, 18*b* of the second coupling portion 18.

Further, the second part 13*c* of the ground-side terminal portion 13 is formed with a retaining tongue piece 20 for restricting the rotation of the ground terminal 2 about the bolts G1, G2 by being fitted into a hole formed in the wall surface at a position distant from the second bolt connection hole 15.

(Configuration of First Additional Ground Terminal 30)

Figure 15:
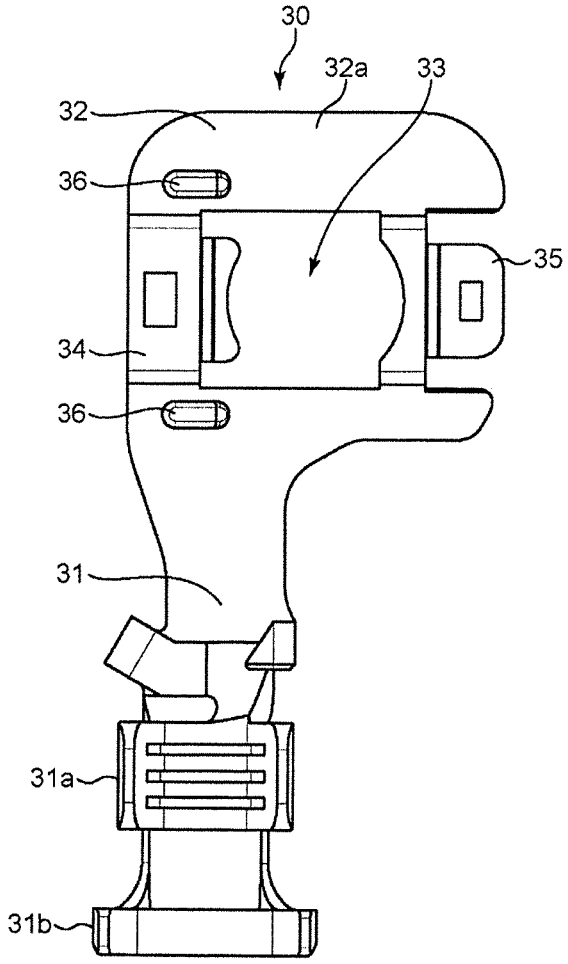
FIG. 15 is a plan view of the first additional ground terminal of FIG. 12.

As shown in FIG. 15, the first additional ground terminal 30 includes a wire-side terminal portion 31 and a ground-side terminal portion 32. The first additional ground terminal 30 is manufactured of a conductive material.

The wire-side terminal portion 31 is mounted on an end of the first additional ground wire E1. The wire-side terminal portion 31 includes a conductor barrel 31*a* and an insulation barrel 31*b*. The conductor barrel 31*a* is composed of a strip-like part with open opposite ends and can fix a part of the end of the first additional ground wire E1 where the conductor is exposed by embracing the exposed part. The insulation barrel 31*b* is arranged side by side with the conductor barrel 31*a*. The insulation barrel 31*b* has a strip-like shape with open opposite ends and can fix a part of the end of the first additional ground wire E where the conductor is not exposed, i.e. a part covered with an insulation coating by embracing the covered part.

The ground-side terminal portion 32 has a flat plate shape and a size capable of covering a bolt hole formed in the wall surface of the vehicle with which the first bolt G1 is to be threadably engaged. The ground-side terminal portion 32 is formed with the first bolt connection hole 33 which is a connecting part connectable with the first bolt G1.

Further, the ground-side terminal portion 32 includes the contact pieces 34, to be respectively engaged with the contact pieces 16*a*, 16*b* of the first coupling portion 16 in the above ground terminal 2. The contact pieces 34, 35 are arranged at opposite sides of the first bolt connection hole 33. The contact pieces 34, 35 project in a direction opposite to the facing direction of the contact pieces 16*a*, 16*b* of the first coupling portion 16 in the above ground terminal 2. Further, the contact pieces 34, 35 are arranged at positions higher than an upper surface 32*a* of the ground-side terminal portion 32. The contact pieces 44, 45 can be engaged in contact with the upper surfaces of the contact pieces 16*a*, 16*b* of the ground-side terminal portion 13 in the above ground terminal 2.

Furthermore, crimping portions 36 project upward from the upper surface 32*a* of the ground-side terminal portion 32. The crimping portions 36 are arranged at opposite sides of the contact piece 34. The crimping portions 36 can crimp the contact pieces 16*a*, 16*b* of the ground-side terminal portion 13 in the ground terminal 2 to the contact pieces 34, 35 by pressing the ground-side terminal portion 13 toward the contact pieces 34, 35.

(Configuration of Second Additional Ground Terminal 40)

Figure 16:
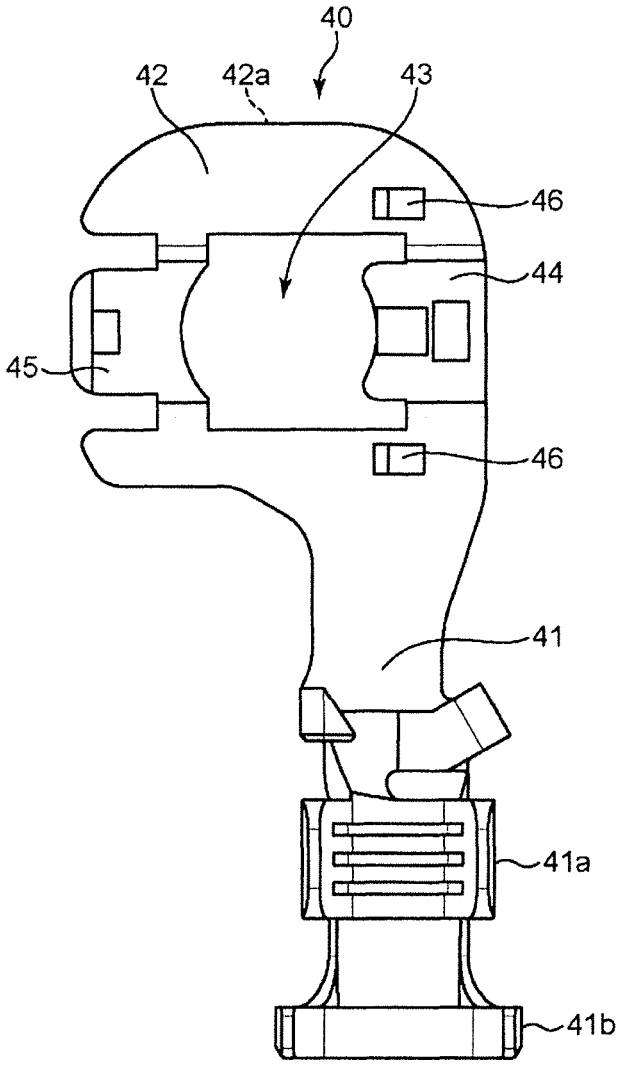
FIG. 16 is a plan view of the second additional ground terminal of FIG. 12.

As shown in FIG. 16, the second additional ground terminal 40 includes a wire-side terminal portion 41 and a ground-side terminal portion 42. The second additional ground terminal 40 is manufactured of a conductive material.

The wire-side terminal portion 41 is mounted on an end of the second ground wire E2. The wire-side terminal portion 41 includes a conductor barrel 41*a* and an insulation barrel 41*b*. The conductor barrel 41*a* is composed of a strip-like part with open opposite ends and can fix a part of the end of the second additional ground wire E2 where the conductor is exposed by embracing the exposed part. The insulation barrel 41*b* is arranged side by side with the conductor barrel 41*a*. The insulation barrel 41*b* has a strip-like shape with open opposite ends and can fix a part of the end of the second additional ground wire E where the conductor is not exposed, i.e. a part covered with an insulation coating by embracing the covered part.

The ground-side terminal portion 42 has a flat plate shape and a size capable of covering a bolt hole formed in the wall surface of the vehicle with which the second bolt G2 is to be threadably engaged. The ground-side terminal portion 42 is formed with the second bolt connection hole 43 which is a connecting part connectable with the second bolt G2.

Further, the ground-side terminal portion 42 includes the contact pieces 44, 45 to be respectively engaged with the contact pieces 18*a*, 18*b* of the second coupling portion 18 in the above ground terminal 2. The contact pieces 44, 45 are arranged at opposite sides of the second bolt connection hole 43. The contact pieces 44, 45 project in a direction opposite to the facing direction of the contact pieces 18*a*, 18*b* of the second coupling portion 18 in the above ground terminal 2. Further, the contact pieces 44, 45 are arranged at positions lower than a lower surface 42*a* of the ground-side terminal portion 42. The contact pieces 44, 45 can be engaged in contact with the lower surfaces of the contact pieces 18*a*, 18*b* of the ground-side terminal portion 13 in the above ground terminal 2.

Furthermore, crimping portions 46 project downward from the lower surface 42*a* of the ground-side terminal portion 42. The crimping portions 46 are arranged at opposite sides of the contact piece 44. The crimping portions 46 can crimp the contact pieces 18*a*, 18*b* of the ground-side terminal portion 13 in the ground terminal 2 to the contact pieces 44, 45 by pressing the ground-side terminal portion 13 toward the contact pieces 44, 45.

In the ground connection device 100 configured as described above, the first additional ground terminal 30 is placed below the first part 13*b* of the ground-side terminal portion 13 of the ground terminal 2 and the contact pieces 16*a*, 16*b* of the first coupling portion 16 and the contact pieces 34, 35 are so engaged that the respective first bolt connection holes 14, 33 communicate. Then, the second additional ground terminal 40 is placed above the second part 13*c* of the ground-side terminal portion 13 of the ground terminal 2 and the contact pieces 18*a*, 18*b* of the second coupling portion 18 and the contact pieces 44, 45 are so engaged that the respective second bolt connection holes 15, 43 communicate. In this way, the wire-side terminal portion 31 of the first additional ground terminal 30 and the wire-side ground terminal 41 of the second additional ground terminal 40 are arranged side by side in parallel with the first and second wire-side terminal portions 11, 12 of the ground terminal 2. As a result, the four ground wires (i.e. copper wire 3, aluminum wire 4, first and second additional ground wires E1, E2) connected to these wire-side terminal portions 11, 12, 31 and 41 can be connected to the first and second bolts G1, G2 as the two ground sections via the ground connection device 100 while being arranged side by side in parallel.

(Characteristics)

(1) In the wiring harness 1 of this embodiment, the single ground terminal 2 includes both the first and second wire-side terminal portions 11, 12 to be individually connected to the copper wire 3 and the aluminum wire 4. These wire-side terminal portions 11, 12 are joined to the ground-side terminal portion 13 connectable to the first and second bolts G1, G2 as the ground sections. In addition, the respective conductor barrels 11*b*, 12*b* of the first and second wire-side terminal portions 11, 12 are individually crimped to the corresponding conductors 3*a*, 4*a* of the copper wire 3 and the aluminum wire 4 to have such crimping heights that the conductor barrels 11*b*, 12*b* can reliably come into contact with the conductors 3*a*, 4*a*. Specifically, the conductor barrel 11*b* of the first wire-side terminal portion 11 is crimped to the copper conductor 3*a* of the copper wire 3 to have such a first crimping height H1 that the conductor barrel 11*b* can come into contact with the surface of the copper conductor 3*a* of the copper wire 3, and the conductor barrel 12*b* of the second wire-side terminal portion 12 is crimped to the aluminum conductor 4*a* of the aluminum wire 4 to have such a second crimping height H2 that the conductor barrel 12*b* can come into contact with the surface of the aluminum conductor 4*a* of the aluminum wire 4 through the oxide film 4*d* covering the surface of the aluminum conductor 4*a*. This enables the conductor barrel 11*b* to be crimped in a state held in contact with the surface of the copper conductor 3*a* of the copper wire 3 and also enables the conductor barrel 12*b* to reliably come into contact with the aluminum conductor 4*a* of the aluminum wire 4 through the oxide film 4*d* covering the surface of the aluminum conductor 4*a*. As a result, a plurality of wires mixedly including the copper wire 3 and the aluminum wire 4 can be collectively connected to the first and second bolts G1, G2 as the ground sections with high reliability. On the other hand, crimping giving priority to tensile strength is possible by setting the large crimping height H1 for the copper wire 3 free from problems of the oxide film. That is, the crimping of the aluminum wire 4 giving priority to connection reliability and the crimping of the copper wire 3 giving priority to tensile strength can be combined by the single ground terminal. In addition, since the plurality of wires mixedly including the copper wire 3 and the aluminum wire 4 can be grounded by the single ground terminal 2, it is possible to suppress an increase in the number of the ground terminals and ground the plurality of wires mixedly including the copper wire 3 and the aluminum wire 4 in a limited space.

(2) In the wiring harness 1 of this embodiment, the ground-side terminal portion 13 includes the first and second bolt connection holes 14, 15 so as to be connected to the first and second bolts G1, G2 as a plurality of ground sections. Thus, if connection to at least one of the first and second bolts G1, G2 is sufficient, the copper wire 3 connected to the first wire-side terminal portion 11 and the aluminum wire 4 connected to the second wire-side terminal portion 12 can be connected to at least one ground section and connection reliability to the ground section can be improved.

(3) In the ground terminal 2 of this embodiment, the ground-side terminal portion 13 needs to have a certain width in the arrangement direction X of the first and second bolt connection holes 14, 15 as compared with the direction perpendicular to this arrangement direction X. However, since the first and second wire-side terminal portions 11, 12 are arranged side by side in parallel with the arrangement direction of these connection holes 14, 15, it is possible to suppress an increase of a space taken up by the wiring harness 1 and the wiring harness 1 including it.

(Modifications)

(A) Although the wiring harness for ground connection is taken as an example of the terminal-wire assembly of the present invention in the above embodiment, the present invention is not limited to this. The present invention can be applied as long as a plurality of wires can be collectively connected to a predetermined mating section by being fastened by crimping terminals.

(B) Although the second crimping height H2 is set lower than the first crimping height H1 on the condition that the respective conductors 3*a*, 4*a* of the copper wire 3 and the aluminum wire 4 to be connected to the ground terminal 2 have the same size (outer diameter dimension) in the above embodiment, the present invention is not limited to this. A relative height relationship of these crimping heights H1, H2 may be appropriately changed according to the sizes of wires to be connected.

Note that the aforementioned specific embodiment mainly includes inventions having the following configurations.

The above terminal-wire assembly includes a copper wire including a conductor made of copper, an aluminum wire including a conductor made of aluminum or aluminum alloy and a crimping terminal connectable to ends of the respective copper wire and aluminum wire. The crimping terminal includes a first wire-side terminal portion shaped to be connectable to the end of the copper wire, a second wire-side terminal portion shaped to be connectable to the end of the aluminum wire and an electrical connecting portion bonded to the first and second wire-side terminal portions and shaped to be electrically connectable to at least one mating section. The first wire-side terminal portion includes a first crimping portion shaped to be crimpable to the conductor exposed at the end of the copper wire. The second wire-side terminal portion includes a second crimping portion shaped to be crimpable to the conductor exposed at the end of the aluminum wire. The first crimping portion is crimped to the conductor of the copper wire to have such a first crimping height that the first crimping portion can come into contact with a surface of the conductor of the copper wire. The second crimping portion is crimped to the conductor of the aluminum wire to have such a second crimping height that the second crimping portion can come into contact with the conductor of the aluminum wire through an oxide film covering a surface of the conductor.

In other words, the above terminal-wire assembly is so configured that a plurality of wires mixedly including the copper wire and the aluminum wire can be collectively connected to the predetermined section by using one crimping terminal capable of being crimped to the respective conductors of the plurality of wires to have different crimping heights. Specifically, according to the above configuration, the crimping terminal includes the first and second wire-side terminal portions to be individually connected to the copper wire and the aluminum wire. These wire-side terminal portions are bonded to the electrical connecting portion connectable to the mating section such as a ground section. In addition, the respective crimping portions of the first and second wire-side terminal portions are individually crimped to the corresponding conductors of the copper wire and the aluminum wire to have such crimping heights that the crimping portions can reliably come into contact with the conductors. Specifically, the first crimping portion is crimped to the conductor of the copper wire to have such a first crimping height that the first crimping portion can come into contact with the surface of the conductor of the copper wire. The second crimping portion is crimped to the conductor of the aluminum wire to have such a second crimping height that the second crimping portion can come into contact with the conductor through the oxide film covering the surface of the conductor of the aluminum wire. This enables the first crimping portion to be crimped in a state held in contact with the surface of the conductor of the copper wire and also enables the second crimping portion to reliably come into contact with the conductor of the aluminum wire through the oxide film covering the surface of the conductor. As a result, the plurality of wires mixedly including the copper wire and the aluminum wire can be collectively connected to the mating section such as the ground section with high reliability. Further, in such a configuration, crimping giving priority to connection reliability of the aluminum wire and crimping giving priority to tensile strength of the copper wire can coexist.

Preferably, the mating section includes a first ground section and a second ground section, and the electrical connecting portion includes a first ground section connecting part connectable to the first ground section and a second ground section connecting part connectable to the second ground section.

According to such a configuration, the electrical connecting portion includes the first and second ground section connecting parts to be connectable to a plurality of ground sections. Thus, if connection to at least one ground section is sufficient, the copper wire connected to the first wire-side terminal portion and the aluminum wire connected to the second wire-side terminal portion can be connected to at least one ground section and connection reliability to the ground section can be improved.

The first and second wire-side terminal portions are preferably arranged side by side in a direction parallel to an arrangement direction of the first and second ground section connecting parts.

According to such a configuration, the electrical connecting portion needs to have a certain width in the arrangement direction of the first and second ground section connecting parts as compared with a direction perpendicular to this arrangement direction. However, since the first and second wire-side terminal portions are arranged side by side in parallel with the arrangement direction of these connecting parts, it is possible to suppress an increase of a space taken up by the crimping terminal and the terminal-wire assembly including it.

The invention claimed is:

1. A terminal-wire assembly, comprising:

a copper wire including a conductor made of copper;

an aluminum wire including a conductor made of aluminum or aluminum alloy; and a crimping terminal connectable to ends of the respective copper wire and aluminum wire;

wherein:

the crimping terminal includes a first wire-side terminal portion shaped to be connectable to the end of the copper wire, a second wire-side terminal portion shaped to be connectable to the end of the aluminum wire and an electrical connecting portion bonded to the first and second wire-side terminal portions and shaped to be electrically connectable to at least one mating section;

the first wire-side terminal portion includes a first crimping portion shaped to be crimpable to the conductor exposed at the end of the copper wire;

the second wire-side terminal portion includes a second crimping portion shaped to be crimpable to the conductor exposed at the end of the aluminum wire;

the first crimping portion is crimped to the conductor of the copper wire to have such a first crimping height that the first crimping portion is capable of coming into contact with a surface of the conductor of the copper wire; and the second crimping portion is crimped to the conductor of the aluminum wire to have such a second crimping height that the second crimping portion is capable of coming into contact with the conductor of the aluminum wire through an oxide film covering a surface of the conductor.

2. A terminal-wire assembly according to claim 1, wherein:

the mating section includes a first ground section and a second ground section; and the electrical connecting portion includes a first ground section connecting part connectable to the first ground section and a second ground section connecting part connectable to the second ground section.

3. A terminal-wire assembly according to claim 2, wherein:

the first and second wire-side terminal portions are arranged side by side in a direction parallel to an arrangement direction of the first and second ground section connecting parts.

* * * * *